United States Patent [19]

Nicolas et al.

[11] Patent Number: 4,555,317

[45] Date of Patent: Nov. 26, 1985

[54] CATHODE FOR THE ELECTROLYTIC PRODUCTION OF HYDROGEN AND ITS USE

[75] Inventors: Edgard Nicolas, Meise-Eversem; Louis Merckaert, Brussels, both of Belgium

[73] Assignee: Solvay & Cie, Brussels, Belgium

[21] Appl. No.: 561,726

[22] Filed: Dec. 15, 1983

[30] Foreign Application Priority Data

Dec. 17, 1982 [FR] France ..... 82 21390

[51] Int. Cl.[4] ..... C25B 1/02; C25B 11/06; C25D 3/12

[52] U.S. Cl. ..... 204/129; 204/48; 204/49; 204/98; 204/128; 204/290 R; 204/292; 204/293

[58] Field of Search ..... 204/48, 49, 98, 128, 204/129, 290 R, 292, 293; 502/192 C, 101

[56] References Cited

U.S. PATENT DOCUMENTS

| | | | |
|---|---|---|---|
| 4,049,841 | 9/1977 | Coker et al. | 204/290 R |
| 4,105,516 | 8/1978 | Martinsons et al. | 204/128 |
| 4,152,240 | 5/1979 | Kuo | 204/290 R |
| 4,160,704 | 7/1979 | Kuo et al. | 204/49 |
| 4,170,536 | 10/1979 | Kawasaki et al. | 204/49 |
| 4,183,790 | 1/1980 | Janjua et al. | 204/290 R |
| 4,190,514 | 2/1980 | Matsuura et al. | 204/290 R |
| 4,224,133 | 9/1980 | Takahashi | 204/290 R |
| 4,251,478 | 2/1981 | Welch et al. | 204/98 |
| 4,290,859 | 9/1981 | Oda et al. | 204/290 R |

FOREIGN PATENT DOCUMENTS

| | | | |
|---|---|---|---|
| 0034185 | 2/1983 | Japan | 204/290 R |

*Primary Examiner*—Andrew H. Metz
*Assistant Examiner*—Terryence Chapman

[57] ABSTRACT

Cathode for the electrolytic production of hydrogen, having an active surface which comprises a nickel substrate and a coating film of dendrites of nickel or cobalt. This cathode can be used in a cell for the electrolysis of sodium chloride brine.

10 Claims, No Drawings

CATHODE FOR THE ELECTROLYTIC PRODUCTION OF HYDROGEN AND ITS USE

The invention relates to a cathode for the electrolytic production of hydrogen, particularly in an alkaline solution, and to its use.

Attempts are generally made in electrolysis processes to reduce the potentials of the electrochemical reactions at the electrodes to the lowest possible value. This is particularly the case in electrolysis processes in which hydrogen gas is produced at the active surface of a cathode, such as processes for the electrolysis of water, aqueous solutions of hydrochloric acid and aqueous solutions of sodium chloride.

The cathodes most commonly used so far for the electrolysis of water or aqueous solutions of sodium chloride or potassium chloride have consisted generally of mild steel plates or gratings. In fact, these known cathodes have the advantage of ease of application and low cost. However, the overvoltage at the liberation of hydrogen at these known steel cathodes is relatively high, which raises the cost of the electrolysis processes. The steel cathodes possess the additional disadvantage of being the seat of gradual corrosion in contact with concentrated aqueous solutions of sodium hydroxide, as they are generally obtained in electrolysis cells with a selectively permeable membrane.

Various solutions have been proposed for reducing the overvoltage at the liberation of hydrogen at the cathodes.

It is thus proposed in U.S. Pat. No. 4,105,516 (PPG INDUSTRIES INC.) to add a transition metal compound to the electrolyte in contact with a mild steel cathode, for example nickel chloride or cobalt chloride. This known process leads to an appreciable lowering of the electrolysis voltage. On the other hand, it retains the disadvantage of using steel cathodes which are the seat of gradual corrosion during electrolysis.

According to Belgian Patent Specification No. 864,880 (OLIN CORPORATION), metal ions with low hydrogen overvoltage are introduced into the catholyte and the plating of these ions is carried out during electrolysis, in the metallic state in situ at the cathode. In this known process, any metal ions with low hydrogen overvoltage can be used and the cathode can be made of copper, steel or any other suitable material; copper cathodes are however recommended particularly, together with plating ions of metals selected from among iron, nickel, chromium, molybdenum and vanadium. However, the copper cathodes used in accordance with the preferred embodiment of this known process also possess the disadvantage of undergoing gradual corrosion in the course of electrolysis. Moreover, the overvoltage at the liberation of hydrogen at the copper cathodes is generally high and experience has shown that, despite the improvement obtained in the overvoltage by the addition of plating ions to the electrolysis bath, the overall electrolysis voltage remained abnormally high.

European Patent Application No. 35,837 (E.I. DU PONT DE NEMOURS AND COMPANY) describes an electrolytic process in which a cathode comprising a coating film of alpha iron on a conductive mild steel substrate, which may be coated with a layer of nickel, is used. This known process possesses the disadvantage of being unsuitable for the electrolysis of aqueous sodium chloride solutions in cells with a selectively permeable membrane, since the alpha iron coating on the cathode undergoes rapid corrosion there in contact with catholytes having a high content of sodium hydroxide. As a result, in practice, this known process makes only a slight improvement in electrolysis voltage possible, at the price of a high consumption of alpha iron which threatens to contaminate the catholyte.

The invention aims at providing a cathode, particularly for use for the electrolytic production of hydrogen in alkaline solution, which enables an improvement in the electrolysis voltage to be made which is definitely greater than the improvements that can be obtained with the known cathodes and processes described above, and which does not possess their disadvantages.

Accordingly, the invention relates to a cathode for the electrolytic production of hydrogen, which has an active surface comprising a nickel substrate and a coating film of dendrites of nickel or cobalt.

In the cathode according to the invention, the dendrites of the coating film are monocrystals of small dimensions, having a branched structure that is very porous, as a result of interruption of growth of crystal seeds, (A. DE SY AND J. VIDTS, "Traité de metallurgie structurale" (Treatise on structural metallurgy), 1962, N.I.C.I. and DUNOD, pages 38 and 39).

The nickel substrate can have any shape suitable for the intended use of the cathode. For example, it may be a solid or perforated plate, a wire, a grating or a pile of small balls. It may have a smooth surface structure; however, a rough surface structure is preferred, because, generally, it lends itself to better adhesion of the dendrite layer. Although it may be formed by a block wholly made of nickel, the nickel substrate consists preferably of a nickel film applied to a substrate of material that is a better conductor of electricity than nickel, for example of copper or aluminium. In this embodiment of the invention, the nickel film has to be impermeable to the electrolytes, when the material used for the underlying support is liable to degradation in contact with these electrolytes. In the case of a support made of material that is inert towards these electrolytes, the nickel film can be either impermeable or permeable, an impermeable film being however preferable in all cases. The thickness in which the nickel film is to be applied depends on various parameters, especially on the nature and the surface structure of the underlying support, and it must be at least great enough to resist being detached under the influence of thermal dilation of the support or through erosion in contact with the electrolyte. In practice, in the case where the support is made of copper, good results have been obtained with nickel films having a thickness of between 5 and 100 microns, more particularly between 10 and 75 microns.

It is desirable for the dendrite coating film to be essentially uniform on the nickel substrate, in a quantity that is at least equal to 0.0005 g per $dm^2$ of substrate area and preferably greater than 0.0008 g per $dm^2$ of substrate area. The maximum permissible value for the thickness of the dendrite film depends on various factors and it is determined particularly by the importance of maintaining a homogeneous active surface on the electrode and avoiding a change in the geometric shape of the cathode. A dendrite film having excessive thickness, in fact, risks being detached locally from the substrate under the influence of the turbulence created by the liberation of hydrogen; in the case of perforated cathodes, moreover, it risks causing obstruction of the apertures of the cathode, which is difficult to control.

For these reasons, it is desirable that the dendrite coating film does not exceed 25 g and preferably 15 g per $dm^2$ of substrate area. Cathodes which have been shown to be particularly advantageous are those in which the dendrite coating film has a weight of between 0.001 and 10 g per $dm^2$ of substrate area, values between 0.002 and 5 g and particularly those that are at least equal to 1 g per $dm^2$ of substrate area generally leading to the best results.

In the cathode according to the invention, the dendrite coating film can be produced by any suitable means. In a preferred embodiment of the electrode according to the invention, the dendrite coating film is an electrolytic deposit of nickel or cobalt which has been produced in an electrolyte containing nickel ions or cobalt ions, while the cathode is the seat of a proton reduction. Preferably, the electrolyte is an aqueous electrolyte, more particularly water or an aqueous solution of an alkali metal chloride or hydroxide, containing nickel or cobalt ions. Good results have been obtained with aqueous alkali metal hydroxide, particularly sodium hydroxide, solutions, containing 20 to 35% by weight of alkali metal hydroxide and, preferably, about 30% by weight of alkali metal hydroxide. The cathode is taken to a sufficient potential to be the seat of a proton reduction.

The choice of the cathode potential suitable to be applied to the cathode depends on various parameters and particularly the nature of the nickel coating—particularly its surface structure, the structure of its crystal lattice, the possible presence of impurities and, if the case arises, its porosity—the choice of the electrolyte used and its concentration. It can be determined, in each particular case, by routine laboratory work. By way of example, in the case where the alkaline solution used is an aqueous solution containing about 30% by weight of sodium hydroxide, the cathode potential has to be set between −1.30 and −2 Volt, most frequently between −1.55 and −1.65 Volt, relative to a calomel reference electrode, comprising a saturated potassium chloride solution. The quantity of nickel ions or cobalt ions to be used in the electrolyte depends on various parameters, particularly the geometric shape of the cathode, the thickness or weight desired for the dendrite coating film, the surface area of the nickel substrate, the nature of the electrolyte and its volume. As a general rule, it can be easily determined, in each particular case, by routine laboratory work. The nickel ions or cobalt ions may be introduced into the electrolyte in a single lot or, alternatively, continuously or intermittently. They may be introduced into the electrolyte by any suitable means, for example, by dissolving a soluble nickel or cobalt compound, such as nickel chloride or cobalt chloride, or by controlled corrosion of a structure—for example, a wire, plate or grating—made of nickel, cobalt or an alloy or compound of these metals, taken to a regulated anode potential in the electrolyte. A useful means consists in dispersing in the electrolyte a nickel powder or a cobalt powder or a powder of a compound or alloy of these metals, the oxides being preferred. In this embodiment of the cathode according to the invention, it is desirable to use the finest possible powder. As a general rule, powders are used in which the mean particle diameter is less than 50 micron and, preferably, does not exceed 35 micron. Generally suitable powders are those in which the mean particle diameter lies between 1 and 32 micron, the best results having been obtained with powders the mean particle diameter of which is less than 25 micron.

In a particular embodiment of the invention, the active surface of the cathode comprises, between the nickel substrate and the dendrite coating film, a porous intermediate layer, designed to reinforce the anchoring of the dendrites on the substrate or to improve the electrochemical properties of the cathode. Advantageously, the porous intermediate layer is made of an electrically conductive material, having good electrochemical properties; this material can be, for example, a platinum group metal or a metal oxide compound of the spinel type, such as those described in European Patent Application No. 8476 (SOLVAY & Cie). Preferably, the porous intermediate layer is made of platinum or is obtained by spraying a nickel oxide powder in a plasma jet.

The cathode according to the invention may be prefabricated. However, in a preferred embodiment, the cathode comprises a dendrite coating film, formed in situ on the cathode which is mounted in the electrolysis cell for which it is intended. To this end, the cathode, provided with the nickel substrate and, possibly, with an intermediate layer, is placed in the cell. Moreover, it may be necessary to regenerate the dendrite coating film periodically, so as to take gradual destruction of the latter into account, for example under the influence of erosion caused by the alkaline solution or the hydrogen gas produced. It is sufficient, for this purpose, to add nickel ions or cobalt ions to the electrolyte at the appropriate time; each addition can be made during a momentary stoppage of the electrolysis or while the latter is kept running. The frequency and extent of these regenerations depend on the speed at which the dendrite coating film is being eroded or detached from the cathode; this speed, in turn, depends on a large number of parameters, amongst which the nature of the nickel substrate, the possible presence of a porous intermediate layer between the substrate and the dendrite coating film, the turbulence and the viscosity of the alkaline solution and the output of hydrogen produced figure prominently. The frequency and extent of these regenerations have accordingly to be determined in each particular case, which can be easily done by routine laboratory work. As a variant, it is also possible to add nickel ions or cobalt ions to the electrolyte continuously, throughout the period during which the cathode is in operation.

The electrode according to the invention finds particularly useful application as a cathode for the electrolytic production of hydrogen in alkaline solution and, more particularly, as a cathode in permeable diaphragm cells or selectively permeable membrane cells for the electrolysis of sodium chloride brines, such as those described, by way of example, in French Patent Specifications Nos. 2,164,623, 2,223,083, 2,230,411, 2,248,335 and 2,387,897 (SOLVAY & Cie).

It has been found that the combination of a nickel substrate and a coating film of nickel dendrites or cobalt dendrites in the cathode according to the invention, other things remaining equal, enabled a large improvement in the electrolysis voltage to be made, not only relative to the same cathode, the active layer of which consists of the nickel substrate only, without the dendrite coating film, but also relative to the cathodes that are made up of nickel substrates carrying a porous active coatng which consists of a material with a lower hydrogen overvoltage than that of cobalt or nickel, such as, for example, a porous platinum coating or a porous coating obtained by spraying a nickel oxide powder in a plasma jet.

The value of the invention will become clear from the description of the following exemplary applications. In each of the following examples, an aqueous brine, containing 255 g of sodium chloride per kg, was submitted to electrolysis in a laboratory cell with vertical electrodes, separated by a cationic selectively permeable membrane, NAFION NX 90107 (DU PONT DE NEMOURS).

The cell, having a cylindrical shape, comprised an anode, formed by a circular titanium plate, perforated by vertical slits and coated with an active material of mixed crystals, consisting of 50% by weight of ruthenium dioxide and 50% by weight of titanium dioxide.

The cathode consisted of a non-perforated disc, the composition of which is defined in each example.

The overall surface area of each electrode of the cell was equal to 102 $cm^2$ and the distance between the anode and the cathode was set at 6 mm, the membrane being placed equidistant from the anode and the cathode.

During electrolysis, the anode chamber was constantly fed with the abovementioned aqueous brine and the cathode chamber with a dilute aqueous solution of sodium hydroxide, the concentration of which was regulated so as to maintain a concentration of about 32% by weight of sodium hydroxide in the catholyte. The temperature in the cell was maintained throughout at 90° C. In all the tests, the electrolysis current density was maintained at the constant value of 3 kA per $m^2$ of cathode area. Chlorine was thus produced at the anode and hydrogen at the cathode.

First test series (in accordance with the invention)

EXAMPLE 1

In the test that is going to be described, a cathode according to the invention was used, the active surface of which consisted of a nickel substrate and a nickel dendrite coating film. To this end, a provisional cathode, formed by a nickel disc, was first placed into the cell; for forming the nickel dendrite film on the disc used as the substrate, the anode chamber and the cathode chamber were respectively fed with the aqueous solution of sodium chloride and the dilute solution of sodium hydroxide, and electrolysis was started with the nickel disc serving as the cathode, at a nominal current density of 3 kA /$m^2$. The electrolysis voltage, measured between the anode and the cathode, stabilised at 3.65 Volt. A solution of nickel chloride was then added to the catholyte, the quantity being adjusted to correspond to an addition of 2 g of nickel. The electrolysis voltage dropped to 3.43 Volt, following the formation of the nickel dendrite film. The improvement, relative to the original voltage, before addition of nickel chloride, is thus 220 mV.

EXAMPLE 2

The procedure was as in Example 1, using an aqueous solution of nickel thiocyanate in place of the nickel chloride solution. When the cell was started, before addition of the nickel thiocyanate solution, the electrolysis voltage stabilised at 3.63 Volt. After addition of the nickel thiocyanate solution and the subsequent formation of the nickel dendrite film on the nickel substrate of the cathode, the electrolysis voltage dropped to 3.38 Volt, which corresponds to an improvement of 250 mV, relative to the starting voltage.

EXAMPLE 3

In this test, a cathode according to the invention was used, the active surface of which consisted of a nickel substrate and a cobalt dendrite coating film. To this end, the procedure was as in Example 1, with the only exceptions that the aqueous nickel chloride solution was replaced by an aqueous cobalt acetate solution, the quantity being adjusted to correspond to an addition of 1 g of cobalt.

At the starting of the cell, using the nickel disc as a provisional cathode, the electrolysis voltage settled at 3.70 Volt. After the formation of a cobalt dendrite coating film on the nickel disc, following the addition of the cobalt acetate solution to the catholyte, the electrolysis voltage dropped to 3.46 Volt, which corresponds to an improvement in voltage of 240 mV.

EXAMPLE 4

The procedure was as in Example 3, with the only exceptions that the cobalt acetate solution was replaced by an aqueous cobalt chloride solution and that the latter was added to the catholyte in a quantity that was adjusted to correspond to an addition of 2 mg of cobalt. At the starting of the cell with the provisional cathode, the electrolysis voltage came to 3.67 Volt. After the addition of the cobalt chloride solution, the electrolysis voltage dropped to 3.58 Volt, which corresponds to an improvement of 90 mV against the original voltage.

EXAMPLE 5

The test of Example 4 was carried further, with further addition of cobalt chloride solution, in a quantity adjusted to correspond to a further addition of 2 mg of cobalt. The electrolysis voltage dropped to 3.46 Volt, thus producing a total improvement of 210 mV, relative to the original voltage.

EXAMPLE 6

The procedure was as in Example 3, but a cobalt oxide powder was substituted for the cobalt acetate solution. The cobalt oxide powder had a mean particle diameter of less than 20 microns.

At the starting of the cell with the provisional cathode, the electrolysis voltage settled at 3.68 Volt. The cobalt oxide powder was then dispersed in the catholyte, in two fractions of equal weight, each corresponding to 1 g of cobalt. The electrolysis voltage went successively to 3.44 Volt and then to 3.36 Volt, thus producing an improvement of 320 mV relative to the original voltage.

EXAMPLE 7

In this test, a cathode according to the invention was used, the active surface of which consisted of a nickel substrate and a nickel dendrite coating film. For producing the cathode, the cell was first provided with a provisional cathode, consisting of a mild steel disc carrying an impermeable 30-micron nickel coating, obtained by electrolytic deposition, this coating being intended to constitute the abovementioned substrate. A nickel dendrite film was then deposited on the substrate and, to this end, a nickel oxide powder was dispersed in the catholyte in a quantity that was adjusted to correspond to 4 g of nickel. The particle size distribution of the nickel oxide powder was characterised by a mean particle diameter of less than 20 microns; it was added to the catholyte in four successive fractions of equal weight. The electrolysis conditions are compiled in Table I. The total improvement in electrolysis voltage is about 300 mV.

TABLE I

| time (days) | electrolysis voltage (V) |
|---|---|
| 1 | 3.91 |
| first addition of nickel oxide powder | |
| 2 | 3.75 |
| 7 | 3.78 |
| 8 | 3.73 |
| second addition of nickel oxide powder | |
| 9 | 3.59 |
| 14 | 3.61 |
| third addition of nickel oxide powder | |
| 15 | 3.60 |
| 22 | 3.60 |
| fourth addition of nickel oxide powder | |
| 23 | 3.57 |
| 28 | 3.60 |

EXAMPLE 8

The procedure was as in the test of Example 7, using as the provisional cathode a copper disc covered with a 16 to 64 micron nickel film, applied by spraying a nickel powder in a plasma jet. At the starting of the cell with this provisional cathode, the electrolysis voltage settled at 3.50 Volt. At first, a porous platinum layer was then deposited electrolytically onto the substrate. To this end, three successive additions of a solution of hexachloroplatinic acid were made, while the cell was kept in operation, the three additions being adjusted to correspond respectively to 2, 3 and 20 mg of platinum. After formation of the porous platinum layer, the electrolysis voltage dropped to 3.28 Volt. The following additions were then made to the catholyte in succession:

two fractions of a nickel oxide powder, having a mean particle diameter of less than 20 micron, each fraction being adjusted to correspond to an addition of 1 g of nickel;

two fractions of a cobalt oxide powder, having a mean particle diameter of between 2 and 32 micron, each fraction being adjusted to correspond to an addition of 1 g of cobalt.

The electrolysis conditions have been compiled in Table II below. It is noted that a first improvement in electrolysis voltage, relative to its value at the starting of the cell, has been produced after the formation of the platinum coat and that a second improvement has again been produced after the deposition of a film of nickel and cobalt dendrites, resulting from the addition of nickel and cobalt powders.

TABLE II

| time (days) | electrolysis voltage (V) |
|---|---|
| 1 | 3.50 |
| 6 | 3.50 |
| 12 | 3.51 |
| first addition of platinum solution | |
| 13 | 3.35 |
| 15 | 3.39 |
| second addition of platinum solution | |
| 16 | 3.35 |
| 20 | 3.35 |
| third addition of platinum solution | |
| 21 | 3.28 |
| first addition of nickel oxide powder | |
| 22 | 3.22 |
| 26 | 3.25 |
| second addition of nickel oxide powder | |

TABLE II-continued

| time (days) | electrolysis voltage (V) |
|---|---|
| 27 | 3.19 |
| first addition of cobalt oxide powder | |
| 28 | 3.13 |
| 33 | 3.13 |
| 34 | 3.17 |
| second addition of cobalt oxide powder | |
| 35 | 3.15 |
| 41 | 3.20 |

The results obtained in each of the preceding tests have been tabulated in Table III below.

TABLE III

| test (No.) | electrolysis voltage at the start (V) | electrolysis voltage at the end of the test (V) | improvement (mV) |
|---|---|---|---|
| 1 | 3.65 | 3.43 | 220 |
| 2 | 3.63 | 3.38 | 250 |
| 3 | 3.70 | 3.46 | 240 |
| 4 | 3.67 | 3.58 | 90 |
| 5 | 3.67 | 3.46 | 210 |
| 6 | 3.68 | 3.36 | 320 |
| 7 | 3.91 | 3.57 | 340 |
| 8 | 3.50 | 3.15 | 350 |

Second test series (comparative tests)

EXAMPLE 9

The procedure in this example was as described in European Patent Application No. 35,837 mentioned above. To this end, a cathode, consisting of a solid mild steel disc, was mounted in the cell and electrolysis was started in the same conditions as in the preceding tests. The electrolysis voltage settled at 3.64 Volt. 2 g of alpha iron were then added to the catholyte. The electrolysis voltage remained unchanged.

EXAMPLE 10

The procedure in this test was as described in Belgian Patent Specification No. 864,880 mentioned above. To this end, a cathode, formed by a solid copper disc, was used in the cell and electrolysis was started. The electrolysis voltage settled at 4 Volt. A nickel oxide powder was then dispersed in the catholyte, the quantity being adjusted to correspond to a weight of 2 g of nickel. The nickel oxide powder had a particle size distribution characterised by a mean particle diameter of less than 20 microns. It was dispersed in the catholyte in two fractions of equal weight. After the addition of the nickel oxide powder, the electrolysis voltage dropped to 3.80 Volt.

EXAMPLE 11

The procedure in this test was as described in U.S. Pat. No. 4,105,516 mentioned above. To this end, a mild steel disc was used as the cathode and electrolysis was started. The electrolysis voltage settled at about 3.91 Volt. A nickel oxide powder was then dispersed in the catholyte, the quantity being adjusted to correspond to a weight of 2 g of nickel. The mean diameter of the powder grains was less than 20 microns. The powder was added to the catholyte in two separate fractions of equal weight, as a result of which the electrolysis voltage dropped to 3.78 Volt.

Comparison of the electrolysis voltages reached in the tests of Examples 1 to 8, according to the invention, with those reached in the tests of Examples 9, 10 and 11 makes the value of the invention immediately clear.

We claim:

1. Cathode for the electrolytic production of hydrogen having an active surface comprising a nickel substrate, a porous coating film of dendrites of a metal selected from the group consisting of nickel and cobalt and a porous intermediate layer of an electrically conductive material interposed between the nickel substrate and the dendrite coating film, said dendrite coating film being produced in situ in a chlor-alkali cell by electrolytic deposition on said intermediate layer whilst said cathode is the seat of an electrolytic proton reduction in an aqueous electrolyte containing nickel ions or cobalt ions.

2. Cathode according to claim 1 characterised in that the nickel substrate is an impermeable nickel film on a support made of an electrically conductive material.

3. Cathode according to claim 1, characterised in that the porous intermediate layer is obtained by spraying a nickel oxide powder in a plasma jet onto the substrate.

4. Cathode according to claim 1 characterised in that the dendrite coating film is an electrolytic deposit produced from nickel ions or cobalt ions, introduced in the form of a powder of nickel oxide or cobalt oxide.

5. A process of producing hydrogen which comprises the steps of positioning in an electrolytic cell an anode and a provisional cathode having a surface of nickel, supplying said cell with an aqueous electrolyte, electrolytically depositing on said provisional cathode a porous layer of an electrically conductive material, adding to the electrolyte a material selected from the group consisting of nickel, cobalt, nickel compound and cobalt compound, passing an electric current between said anode and provisional cathode to promote an electrolytic proton reduction and hydrogen evolution on said provisional cathode and simultaneously to form on said cathode a porous coating film of dendrites of nickel or cobalt, and thereafter passing electric current between said anode and coated cathode to produce hydrogen at the cathode.

6. A process according to claim 5, in which said electrolyte comprises an aqueous solution of an alkali metal hydroxide.

7. A process for the electrolytic produciton of hydrogen which comprises providing in an electrolytic cell containing an alkaline electrolyte, an anode and a cathode, said cathode having an active surface which comprises a nickel substrate, a porous coating film of dendrites of a metal selected from the group consisting of nickel and cobalt and a porous layer of an electrically conductive material interposed between said nickel substrate and said coating film of dendrites, said film of dendrites being formed in situ by electrolytic deposition on said cathode whilst said cathode is the seat of an electrolytic proton reduction in an aqueous electrolyte containing nickel ions or cobalt ions, and passing electric current between said anode and cathode to produce hydrogen gas at said cathode with minimum over-voltage.

8. A process according to claim 7, in which said porous intermediate layer is produced by spraying a nickel oxide powser in a plasma jet onto said substrate.

9. A process according to claim 7, in which said cathode is made of an electrically conductive material and is coated with an impermeable film of nickel to form said nickel substrate.

10. A process according to claim 7, in which said nickel ions or cobalt ions are provided by introducing a powder of nickel oxide or cobalt oxide into said electrolyte.

* * * * *